US011097925B2

(12) United States Patent
Cao et al.

(10) Patent No.: US 11,097,925 B2
(45) Date of Patent: Aug. 24, 2021

(54) DEVICE FOR CAGE JAMMING BUFFER OF LARGE-TONNAGE HOISTING SYSTEM OF ULTRA-DEEP SHAFT

(71) Applicants: China University of Mining and Technology, Jiangsu (CN); XUZHOU ZHIRUN MINING EQUIPMENT SCIENCE AND TECHNOLOGY CO., LTD, Jiangsu (CN); INNER MONGOLIA UNIVERSITY OF TECHNOLOGY, Inner Mongolia (CN)

(72) Inventors: Guohua Cao, Jiangsu (CN); Zhencai Zhu, Jiangsu (CN); Ying Wang, Jiangsu (CN); Ke Wang, Jiangsu (CN); Chunli Hua, Jiangsu (CN); Gongbo Zhou, Jiangsu (CN); Weihong Peng, Jiangsu (CN); Yuxing Peng, Jiangsu (CN); Wei Li, Jiangsu (CN); Yu Tang, Jiangsu (CN); Shanzeng Liu, Jiangsu (CN); Xin Zhang, Jiangsu (CN)

(73) Assignees: China University of Mining and Technology, Jiangsu (CN); XUZHOU ZHIRUN MINING EQUIPMENT SCIENCE AND TECHNOLOGY CO., LTD, Jiangsu (CN); INNER MONGOLIA UNIVERSITY OF TECHNOLOGY, Inner Mongolia (CN)

( * ) Notice: Subject to any disclaimer, the term of this patent is extended or adjusted under 35 U.S.C. 154(b) by 56 days.

(21) Appl. No.: 16/613,806

(22) PCT Filed: Sep. 21, 2018

(86) PCT No.: PCT/CN2018/106895
§ 371 (c)(1),
(2) Date: Nov. 15, 2019

(87) PCT Pub. No.: WO2020/006890
PCT Pub. Date: Jan. 9, 2020

(65) Prior Publication Data
US 2020/0377336 A1 Dec. 3, 2020

(30) Foreign Application Priority Data
Jul. 6, 2018 (CN) ..... 201810735607.2

(51) Int. Cl.
*B66B 5/28* (2006.01)
*B66B 15/06* (2006.01)
(Continued)

(52) U.S. Cl.
CPC ..... *B66B 5/282* (2013.01); *B66B 5/027* (2013.01); *B66B 7/10* (2013.01)

(58) Field of Classification Search
USPC ..... 187/288
See application file for complete search history.

(56) References Cited

U.S. PATENT DOCUMENTS 5,195,616 A 3/1993 Yoo et al.

FOREIGN PATENT DOCUMENTS

CN 101643174 2/2010
CN 202657793 1/2013
(Continued)

OTHER PUBLICATIONS

"International Search Report (Form PCT/ISA/210) of PCT/CN2018/106895," dated Mar. 19, 2019, pp. 1-5.

*Primary Examiner* — Christopher Uhlir
(74) *Attorney, Agent, or Firm* — JCIPRNET

(57) ABSTRACT

A device for cage jamming buffer of large-tonnage hoisting system of ultra-deep shaft is provided. End cage jamming buffer mechanisms are added at both ends of an automatic wire rope tension balancing mechanism, wherein the end cage jamming buffer mechanisms include an end buffer
(Continued)

module and an end fixing module, and the end buffer module and the end fixing module are respectively mounted on shafts of the automatic wire rope tension balancing mechanisms at two ends. The end buffer module mainly consists of a buffer bearing pedestal, a limit block, a buffer block, and a stop block sequentially mounted on the shaft of the automatic wire rope tension balancing mechanism at one end. The end fixing module mainly consists of a fixing bearing pedestal and a fixing block mounted on the shaft, wherein the fixing bearing pedestal is connected to a transmission gear by an adjusting bolt.

10 Claims, 1 Drawing Sheet

(51) Int. Cl.
*B66B 5/02* (2006.01)
*B66B 7/10* (2006.01)

(56) References Cited

FOREIGN PATENT DOCUMENTS

| | | |
|---|---|---|
| CN | 103101824 | 5/2013 |
| CN | 204384653 | 6/2015 |
| CN | 205367385 | 7/2016 |

DEVICE FOR CAGE JAMMING BUFFER OF LARGE-TONNAGE HOISTING SYSTEM OF ULTRA-DEEP SHAFT

CROSS-REFERENCE TO RELATED APPLICATION

This application is a 371 of international application of PCT application serial no. PCT/CN2018/106895, filed on Sep. 21, 2018, which claims the priority benefit of China application no. 201810735607.2, filed on Jul. 6, 2018. The entirety of each of the above mentioned patent applications is hereby incorporated by reference herein and made a part of this specification.

BACKGROUND OF THE INVENTION

Field of the Invention

The present invention relates to a device for cage jamming buffer of a hoisting system, which is especially suitable for a buffer action when a cage jamming accident occurs in a large-tonnage hoisting system of an ultra-deep shaft, and can be widely used in the large-tonnage hoisting system of the ultra-deep shaft to avoid occurrence of serious accidents.

Description of Related Art

In a large-tonnage hoisting system of an ultra-deep shaft, a cage jamming failure may occur during operation of the system, for example, due to subjective reasons such as over-speed hoisting or objective reasons such as poor equipment maintenance. The cage jamming failure may damage a cage guide and a wire rope, affecting production efficiency of a mine, or even in the worst case, may lead to serious accidents such as rope breaking and container falling. The existing coping strategy for the cage jamming accidents is mainly to detect a load during operation of the hoisting system by means of a sensor, and alert an operator to take emergency measures through a monitoring system and an alarm device. The sensor used in this method collects data with low accuracy and requires periodic maintenance.

SUMMARY OF THE INVENTION

To overcome the foregoing deficiencies of the prior art, the present invention provides a device for cage jamming buffer of a large-tonnage hoisting system of an ultra-deep shaft. The device for cage jamming buffer can ensure that a wire rope is not broken when a cage jamming failure occurs in the large-tonnage hoisting system of the ultra-deep shaft, has a simple structure, and is quick and convenient to adjust.

The technical solution adopted by the present invention for solving the technical problem thereof is: a device for cage jamming buffer of a large-tonnage hoisting system of an ultra-deep shaft, comprising: a plurality of automatic wire rope tension balancing mechanisms coaxially connected in series, wherein end cage jamming buffer mechanisms are disposed at outer ends of the automatic wire rope tension balancing mechanisms at two ends, and adjacent ends of the plurality of automatic wire rope tension balancing mechanisms are respectively provided with an internal bearing pedestal and are connected by means of the internal bearing pedestals. The end cage jamming buffer mechanisms include an end buffer module and an end fixing module, and the end buffer module and the end fixing module are respectively mounted on shafts of the automatic wire rope tension balancing mechanisms at the two ends. The end buffer module mainly consists of a buffer bearing pedestal, a limit block, a buffer block, and a stop block sequentially mounted on the shaft of the automatic wire rope tension balancing mechanism at one end, wherein the limit block is fixedly connected to an outer side of the buffer bearing pedestal by means of a fixing bolt and an adjusting bolt, the buffer bearing pedestal, the limit block, and a transmission gear of the automatic wire rope tension balancing mechanism at said end are sequentially connected by means of a buffer bolt, and the buffer bearing pedestal is fixed on a container. The end fixing module mainly consists of a fixing bearing pedestal mounted on the shaft of the automatic wire rope tension balancing mechanism at the other end, wherein the fixing bearing pedestal is connected to a transmission gear of the automatic wire rope tension balancing mechanism at said end by means of an adjusting bolt, there is also a fixing block disposed between the transmission gear and the fixing bearing pedestal and mounted on the shaft thereof, and the fixing bearing pedestal is placed on the container. The stop block and the fixing block are fixed on the shafts, and respectively drive the transmission gears to move together with the rotation of the shafts.

Compared with the prior art, in the device for cage jamming buffer of the large-tonnage hoisting system of the ultra-deep shaft according to the present invention, the end cage jamming buffer mechanisms are disposed at the outer ends of the automatic wire rope tension balancing mechanisms at two ends, the end cage jamming buffer mechanisms include the end buffer module and the end fixing module, and the end buffer module and the end fixing module are respectively mounted on the shafts of the automatic wire rope tension balancing mechanisms at two ends. The buffer action of a drum during cage jamming is achieved by means of the buffer bolts on the buffer bearing pedestal. When the torque corresponding to the tensile force of the wire rope is greater than the shearing strength of the buffer bolts, it is regarded as cage jamming. The rotation of the transmission gears drives the shafts and the drum to rotate and move the shafts in the axial direction, and each of the automatic wire rope tension balancing mechanisms axially moves along with the shaft until the stop block is in contact with the buffer block. The length of the hoisting wire rope released during this period of time is buffer distance, which ensures that the hoisting wire rope can be buffered without being broken when a cage jamming failure occurs in the hoisting system, thereby solving the problem of breaking the wire rope due to the time lag in the process from the moment cage jamming occurs to the shutdown. The present invention realizes a suitable buffer distance of the wire rope when the cage jamming failure occurs in the hoisting system by means of the buffer bolt and the buffer blocks, and has a simple structure, and is quick and convenient to adjust.

BRIEF DESCRIPTION OF THE DRAWINGS

The present invention is further described below with reference to the accompanying drawings and embodiments.

DETAILED DESCRIPTION OF THE INVENTION

To make the objectives, technical solutions, and advantages of embodiments of the present invention clearer, the technical solutions in the embodiments of the present invention will be described below clearly and completely with reference to the accompanying drawings in the embodiments of the present invention. It is obvious that the described embodiments are part of the embodiments of the present invention, rather than all of the embodiments. All other embodiments obtained by a person of ordinary skill in the art based on the described embodiments of the present invention without involving any inventive effort are within the protection scope of the present invention.

Figure 1:
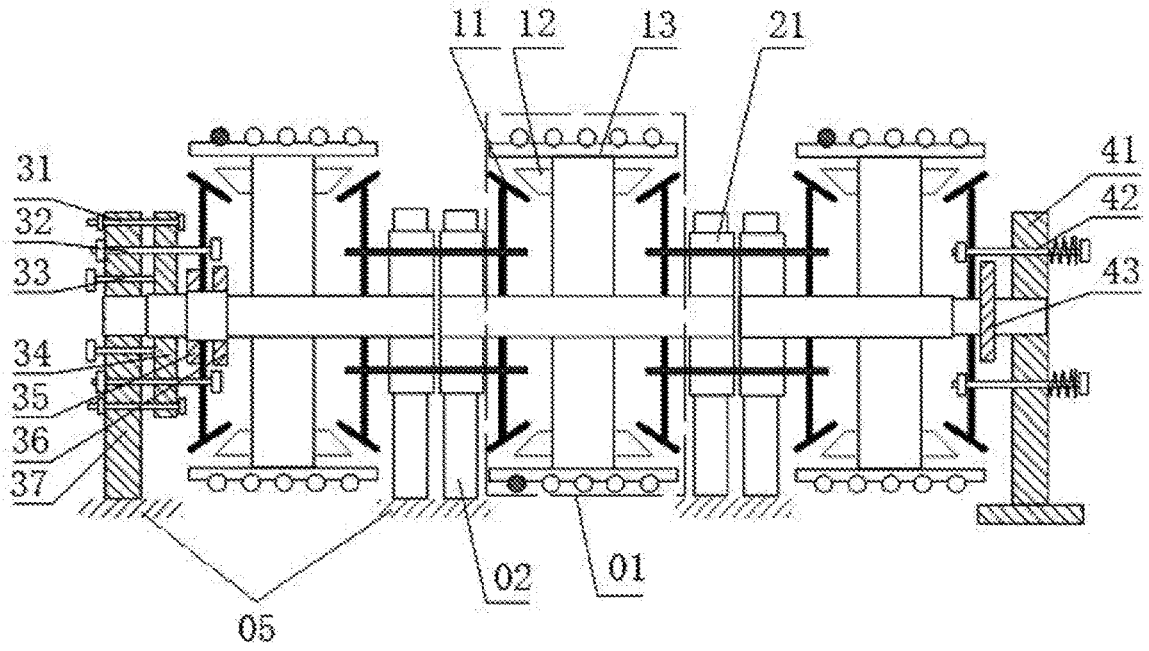
FIG. 1 is a schematic structural diagram of an embodiment of a device for cage jamming buffer of a three-rope hoisting system of the present invention.
Figure 2:
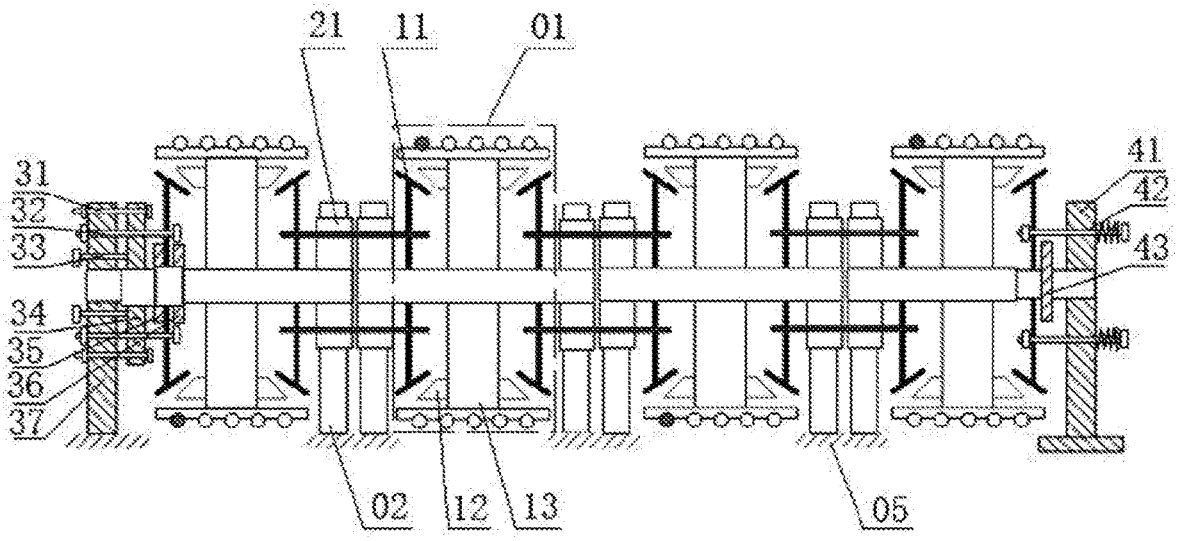
FIG. 2 is a schematic structural diagram of an embodiment of a device for cage jamming buffer of a four-rope hoisting system of the present invention.

FIGS. 1 and 2 respectively show structural embodiments of devices for cage jamming buffer of a three-rope hoisting system and a four-rope hoisting system. FIG. 1 shows a device for cage jamming buffer of a large-tonnage hoisting system of an ultra-deep shaft, comprising three automatic wire rope tension balancing mechanisms 01 coaxially connected in series. End cage jamming buffer mechanisms are disposed at outer ends of two of the automatic wire rope tension balancing mechanisms 01 at the leftmost and rightmost ends. Two ends of the automatic wire rope tension balancing mechanism 01 in the middle, and a right end and a left end of the respective automatic wire rope tension balancing mechanisms 01 adjacent thereto on the left side and the right side are respectively provided with an internal bearing pedestal 02. An intermediate rotating ring 21 is disposed on the internal bearing pedestal 02. Two bevel gears 11 of the middle automatic wire rope tension balancing mechanism 01 and bevel gears 11 at the inner sides of the two automatic wire rope tension balancing mechanisms 01 at both ends are fixed on the intermediate rotating rings 21. A lower end of the internal bearing pedestal 02 is fixed on a container 05. A plurality of key slots and a plurality of bolt holes are uniformly distributed on the intermediate rotating ring 21 of the internal bearing pedestal 02. The bevel gear 11 is fixed on the intermediate rotating ring 21 by means of bolts. Two intermediate rotating rings 21 are connected by means of keys. Each of the three automatic wire rope tension balancing mechanisms 01 comprises a shaft, bevel gears 11, bevel pinions 12, a drum 13, and a hoisting wire rope. The shafts of the three automatic wire rope tension balancing mechanisms 01 may be three independent short shafts as shown, or may share a through shaft. The bevel gears 11 and the drum 13 are mounted on the shaft by means of bearings. The drum 13 is located in the middle of the shaft. Two sides of the drum 13 are respectively provided with one bevel gear 11. A plurality of the bevel pinions 12 meshing with the bevel gears 11 are circumferentially and uniformly distributed at both ends inside the drum 13. The drum 13 consists of an outer ring, an inner ring, and a drum plate embedded between the inner ring and the outer ring. A plurality of gear shafts are embedded in the drum plate. The bevel pinions 12 are mounted on the gear shaft. The hoisting wire rope is wound around each drum 13. The hoisting and winding directions of the wire ropes on the drums 13 of the adjacent automatic wire rope tension balancing mechanisms are opposite to each other. Components in the automatic wire rope tension balancing mechanism 01 mating with the shaft are axially positioned and restrained by means of an axial check ring or the like. The end cage jamming buffer mechanisms comprise an end buffer module and an end fixing module. The bevel gears 11 at the outer sides of the two automatic wire rope tension balancing mechanisms 01 at both ends are respectively connected to the end buffer module and the end fixing module. The end buffer module mainly consists of a buffer bearing pedestal 37, a limit block 34, a buffer block 35, and a stop block 36 sequentially mounted on the shaft of the automatic wire rope tension balancing mechanism 01 at one end of the two ends. The limit block 34 and the shaft are spirally connected to each other, and are rotated and translated relative to each other, thereby ensuring that the shaft can axially move while rotating. The limit block 34 is fixedly connected to an outer side of the buffer bearing pedestal 37 by means of the fixing bolts 31 and the first adjusting bolts 33. The buffer bearing pedestal 37, the limit block 34, and a first transmission gear of the automatic wire rope tension balancing mechanism 01 at this end are sequentially connected by means of the buffer bolts 32. The buffer block 35 is fixedly mounted on one end face of the first transmission gear. The stop block 36 is located at the other end face of the transmission gear and fixedly connected to the shaft. The buffer bearing pedestal 37 is fixed on the container 05. The end fixing module mainly consists of a fixing bearing pedestal 41 mounted on the shaft of the automatic wire rope tension balancing mechanism 01 at the other end of the two ends. The fixing bearing pedestal 41 is connected to a second transmission gear of the automatic wire rope tension balancing mechanism 01 at this end by means of the second adjusting bolts 42. There is also a fixing block 43 disposed between the second transmission gear and the fixing bearing pedestal 41 and mounted on the shaft thereof. The fixing bearing pedestal 41 is placed on the container 05. Three layers of bolt holes are distributed on the buffer bearing pedestal 37 from outside to inside for mounting the fixing bolts 31, the buffer bolts 32, and the first adjusting bolts 33, respectively. Four bolt holes are circumferentially and uniformly distributed in each layer. The positions of the bolt holes distributed on the limit block 34 are the same as those of the bolt holes on the buffer bearing pedestal 37. Four bolt holes are uniformly distributed on the fixing bearing pedestal 41 for mounting the adjusting bolt 42. Before the shafts rotate, the stop block 36 and the fixing block 43 axially limit the transmission gears, and rotate and axially move along with the shafts. A certain distance is reserved between the buffer block 35 and the limit block 34 to ensure a certain buffer distance of the hoisting wire rope. The device for cage jamming buffer of the large-tonnage hoisting system of the ultra-deep shaft in the embodiment of FIG. 2 differs from the embodiment of FIG. 1 only in that there are four automatic wire rope tension balancing mechanisms 01.

The working principles of the embodiments of FIGS. 1 and 2 and the hoisting of more wire ropes are as follows:

When a cage jamming failure occurs, the tensions of all the wire ropes increase synchronously with the operation of the hoisting system, the torques on all the drums 13 are equal and increase synchronously, and the torque is transmitted to the buffer bolts 32. The buffer bolts 32 are broken when the torque value exceeds the shearing strength of the buffer bolts 32, so that the bevel gear 11 connected to the end buffer module rotates and drives the shaft to rotate, and the shaft also moves in the axial direction under the action of the limit block 34 spirally connected thereto. As the shaft rotates and translates until the stop block 36 is in contact with the buffer block 35 on the bevel gear 11, the buffer block 35 mounted on the bevel gear 11 limits the movement of the stop block 36, while the translation of the shaft is limited and it stops rotating, and the release of the wire rope on the drum 13 is stopped, so that the length of the hoisting wire rope released in the process during which after the buffer bolts 32 are sheared off, the drum 13 rotates with the shaft until it stops is a buffer distance, which effectively performs a buffer action of the hoisting wire rope in the cage jamming failure, thereby solving the problem of breaking the wire rope due to the time lag in the process from the moment cage jamming occurs to the shutdown.

The present invention has the following advantages.

1) The present invention determines the tension value of the wire rope when cage jamming occurs in the system by selecting the buffer bolt 32 with an appropriate shearing strength, and the device is simple and convenient to install and replace;

2) The present invention determines the buffer length of the wire rope by reserving an axial distance between the stop block 36 and the buffer block 35 on the shaft, thereby ensuring an appropriate action distance of the buffer device; and 3) A reasonable buffer distance of the wire rope in the cage jamming failure is ensured by the buffer device of the present invention, providing a new buffer device and method for a large-tonnage hoisting system of an ultra-deep shaft in which a cage jamming failure occurs.

The above are only preferred embodiments of the present invention, and are not intended to limit the present invention in any way. Any simple modifications and equivalent changes made to the foregoing embodiments in accordance with the technical spirit of the present invention fall within the protection scope of the present invention.

What is claimed is:

1. A device for cage jamming buffer of large-tonnage hoisting system of ultra-deep shaft, comprising: a plurality of automatic wire rope tension balancing mechanisms coaxially connected in series, wherein end cage jamming buffer mechanisms are disposed at outer ends of the automatic wire rope tension balancing mechanisms at two ends, and adjacent ends of the plurality of automatic wire rope tension balancing mechanisms are respectively provided with an internal bearing pedestal and are connected by the internal bearing pedestals;

wherein the end cage jamming buffer mechanisms comprise an end buffer module and an end fixing module, and the end buffer module and the end fixing module are respectively mounted on a shaft of the automatic wire rope tension balancing mechanisms at the two ends; the end buffer module comprises a buffer bearing pedestal, a limit block, a buffer block, and a stop block sequentially mounted on the shaft of the automatic wire rope tension balancing mechanisms at one end of the two ends, wherein the limit block is fixedly connected to an outer side of the buffer bearing pedestal by fixing bolts and first adjusting bolts, the buffer bearing pedestal, the limit block, and a first transmission gear of the automatic wire rope tension balancing mechanisms at the end are sequentially connected by buffer bolts, and the buffer bearing pedestal is fixed on a container; the end fixing module comprises a fixing bearing pedestal mounted on the shaft of the automatic wire rope tension balancing mechanisms at the other end of the two ends, wherein the fixing bearing pedestal is connected to a second transmission gear of the automatic wire rope tension balancing mechanisms at the other end of the two ends by second adjusting bolts, there is also a fixing block disposed between the second transmission gear and the fixing bearing pedestal and mounted on the shaft thereof, and the fixing bearing pedestal is placed on the container.

2. The device for cage jamming buffer of large-tonnage hoisting system of ultra-deep shaft according to claim 1, wherein the limit block and the shaft are spirally connected to each other, and are rotated and translated relative to each other.

3. The device for cage jamming buffer of large-tonnage hoisting system of ultra-deep shaft according to claim 1, wherein the buffer block is fixedly mounted on one end face of the first transmission gear of the automatic wire rope tension balancing mechanisms at the end of the two ends, and the stop block is located at the other end face of the first transmission gear of the automatic wire rope tension balancing mechanisms at the end of the two ends and fixedly connected to the shaft.

4. The device for cage jamming buffer of large-tonnage hoisting system of ultra-deep shaft according to claim 1, wherein bolt holes of three layers are distributed on the buffer bearing pedestal from outside to inside for mounting the fixing bolts, the buffer bolts, and the first adjusting bolts, respectively, and 4-8 bolt holes of the bolt holes are circumferentially and uniformly distributed in each layer; the bolt holes are distributed on the limit block and are located at the same positions as the bolt holes of the three layers distributed on the buffer bearing pedestal; and other 4-8 bolt holes are uniformly distributed on the fixing bearing pedestal for mounting the second adjusting bolts.

5. The device for cage jamming buffer of large-tonnage hoisting system of ultra-deep shaft according to claim 1, wherein the stop block and the fixing block are fixed on the shaft, and respectively drive the first and the second transmission gears of the automatic wire rope tension balancing mechanisms to move together with a rotation of the shaft.

6. The device for cage jamming buffer of large-tonnage hoisting system of ultra-deep shaft according to claim 1, wherein the automatic wire rope tension balancing mechanisms comprises the shaft, bevel gears, bevel pinions, drums, and hoisting wire ropes, the bevel gears and the drums are mounted on the shaft by bearings, the drums are located in the middle of the shaft, two sides of the drums are respectively provided with one bevel gear, and the bevel pinions-meshing with the bevel gears are circumferentially and uniformly distributed at opposite ends inside the drums; the hoisting wire ropes are respectively wound around the drum, and hoisting and winding directions of the hoisting wire ropes on the drums of two adjacent of the automatic wire rope tension balancing mechanisms are opposite to each other.

7. The device for cage jamming buffer of large-tonnage hoisting system of ultra-deep shaft according to claim 6, wherein one of the internal bearing pedestals is disposed at respective outer sides of the two bevel gears of each of the automatic wire rope tension balancing mechanisms in the middle, one of the internal bearing pedestals is disposed at respective outer sides of the bevel gears located at inner sides of two of the automatic wire rope tension balancing mechanisms at the ends, an intermediate rotating ring is disposed on the internal bearing pedestal, the bevel gear is fixed on the intermediate rotating ring, and a lower end of the internal bearing pedestal is fixed on the container.

8. The device for cage jamming buffer of large-tonnage hoisting system of ultra-deep shaft according to claim 7, wherein a plurality of key slots and a plurality of bolt holes are uniformly distributed on the intermediate rotating ring of the internal bearing pedestal, the bevel gear is fixed on the intermediate rotating ring by bolts with the same number as the bolts holes, and two of the intermediate rotating rings are connected by keys with the same number as the key slots.

9. The device for cage jamming buffer of large-tonnage hoisting system of ultra-deep shaft according to claim 6, wherein each of the drums consists of an outer ring, an inner ring, and a drum plate embedded between the inner ring and the outer ring, a plurality of gear shafts are embedded in the drum plate, and the bevel pinions are mounted on the gear shafts.

10. The device for cage jamming buffer of large-tonnage hoisting system of ultra-deep shaft according to claim 6, wherein the bevel gears at outer sides of two of the automatic wire rope tension balancing mechanisms at the ends are respectively connected to the end buffer module and the end fixing module.

* * * * *